US008434282B2

(12) United States Patent
Scott et al.

(10) Patent No.: US 8,434,282 B2
(45) **Date of Patent: *May 7, 2013**

(54) SYSTEM FOR CARPET TILE INSTALLATION

(75) Inventors: Graham A. H. Scott, LaGrange, GA (US); David D. Oakey, Atlanta, GA (US); John P. Bradford, LaGrange, GA (US); Keith N. Gray, Marietta, GA (US)

(73) Assignee: Interface, Inc., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/595,487

(22) Filed: Aug. 27, 2012

(65) Prior Publication Data

US 2013/0014460 A1 Jan. 17, 2013

Related U.S. Application Data

(63) Continuation of application No. 12/270,129, filed on Nov. 13, 2008, now Pat. No. 8,381,473, which is a continuation of application No. 11/018,947, filed on Dec. 21, 2004, now Pat. No. 7,464,510, which is a continuation-in-part of application No. 10/638,878, filed on Aug. 11, 2003, now abandoned, which is a continuation-in-part of application No. 10/381,025, filed as application No. PCT/US01/29313 on Sep. 19, 2001, now abandoned.

(60) Provisional application No. 60/619,340, filed on Oct. 15, 2004, provisional application No. 60/403,790, filed on Aug. 15, 2002, provisional application No. 60/233,680, filed on Sep. 19, 2000.

(51) Int. Cl.
*E04B 2/00* (2006.01)
*E04B 5/00* (2006.01)
*E04B 9/00* (2006.01)

(52) U.S. Cl.
USPC ..... 52/506.05; 52/311.2; 52/385; 52/391; 52/745.05; 52/747.11; 428/86; 428/100; 428/99; 428/101; 428/356; 428/354

(58) Field of Classification Search ..... 52/506.05, 52/311.2, 385, 391, 745.05, 747.11; 428/86, 428/100, 99, 101, 356, 354
See application file for complete search history.

(56) References Cited

U.S. PATENT DOCUMENTS 406,866 A 7/1889 Atwater
833,571 A 10/1906 Bailey (Continued)

FOREIGN PATENT DOCUMENTS

AT 360217 B 12/1980
AU 2003265409 A1 3/2004

(Continued)

OTHER PUBLICATIONS

Extended European Search Report, EP Application No. 10180493.8, Nov. 15, 2010, 5 pages.

(Continued)

*Primary Examiner* — William Gilbert
*Assistant Examiner* — Chi Q Nguyen
(74) *Attorney, Agent, or Firm* — Kilpatrick Townsend & Stockton LLP

(57) ABSTRACT

Connectors for joining adjacent modular floor covering units. The connectors include a film and an adhesive layer coated on one side of the film. To install tiles using the connectors, a first tile is placed on the floor and a connector is positioned so that the adhesive layer faces upward and does not contact the floor. The connector is typically positioned so that only a portion of the adhesive layer adheres to the underside of the tile, leaving the remainder of the connector extending from the underside of the tile. Tiles are then positioned adjacent the first tile so that a portion of the connector adheres to the adjacent tiles. In this way, the connectors span adjacent tile edges. The tiles are assembled on a underlying flooring surface without the need to attach them to the floor surface.

14 Claims, 9 Drawing Sheets

U.S. PATENT DOCUMENTS

| | | | |
|---|---|---|---|
| 1,685,362 | A | 9/1928 | Joseph |
| 1,711,149 | A | 4/1929 | Joseph |
| 2,250,669 | A | 7/1941 | Jamgotchian |
| 2,367,536 | A | 1/1945 | Spitzli |
| 2,647,850 | A | 8/1953 | Reinhard |
| 2,702,919 | A | 3/1955 | Judge |
| 2,709,826 | A | 6/1955 | Reinhard |
| 2,726,419 | A | 12/1955 | Saks et al. |
| 3,083,393 | A | 4/1963 | Nappi |
| 3,120,083 | A | 2/1964 | Dahlberg et al. |
| 3,241,662 | A | 3/1966 | Robinson et al. |
| 3,271,217 | A | 9/1966 | Mapson |
| 3,494,006 | A | 2/1970 | Brumlik |
| 3,538,536 | A | 11/1970 | Pecorella |
| 3,558,384 | A | 1/1971 | Ronning |
| 3,558,385 | A | 1/1971 | Ronning |
| 3,558,386 | A | 1/1971 | Ronning |
| 3,696,459 | A | 10/1972 | Kucera et al. |
| 3,712,845 | A | 1/1973 | Hartung |
| 3,748,211 | A | 7/1973 | Hoopengardner |
| 3,788,941 | A | 1/1974 | Kupits |
| 3,819,773 | A | 6/1974 | Pears |
| 3,858,269 | A | 1/1975 | Sutton et al. |
| 3,928,690 | A | 12/1975 | Settineri et al. |
| 3,969,564 | A | 7/1976 | Carder |
| 4,012,544 | A | 3/1977 | Richards |
| 4,114,346 | A | 9/1978 | Kelly |
| 4,152,473 | A | 5/1979 | Layman |
| 4,196,254 | A | 4/1980 | Puskadi |
| 4,242,389 | A | 12/1980 | Howell |
| 4,322,516 | A | 3/1982 | Wiest et al. |
| 4,340,633 | A | 7/1982 | Robbins, Jr. |
| 4,489,115 | A | 12/1984 | Layman et al. |
| 4,557,774 | A | 12/1985 | Hoopengardner |
| 4,561,232 | A | 12/1985 | Gladden, Jr. et al. |
| 4,562,938 | A | 1/1986 | Loder |
| 4,564,546 | A | 1/1986 | Jones |
| 4,571,363 | A | 2/1986 | Culbertson et al. |
| 4,680,209 | A | 7/1987 | Zybko et al. |
| 4,695,493 | A | 9/1987 | Friedlander et al. |
| 4,702,948 | A | 10/1987 | Sieber-Gadient |
| 4,769,895 | A | 9/1988 | Parkins |
| 4,822,658 | A | 4/1989 | Pacione |
| 4,824,498 | A | 4/1989 | Goodwin et al. |
| 4,920,720 | A | 5/1990 | LaBianca |
| 4,947,602 | A | 8/1990 | Pollasky |
| 4,988,551 | A | 1/1991 | Zegler |
| 5,012,590 | A | 5/1991 | Wagner et al. |
| 5,018,235 | A | 5/1991 | Stamatiou et al. |
| 5,034,258 | A | 7/1991 | Grace |
| 5,096,764 | A | 3/1992 | Terry et al. |
| 5,114,774 | A | 5/1992 | Maxim, Jr. |
| 5,116,439 | A | 5/1992 | Raus |
| 5,120,587 | A | 6/1992 | McDermott, III et al. |
| 5,191,692 | A | 3/1993 | Pacione |
| 5,205,091 | A | 4/1993 | Brown |
| 5,217,552 | A | 6/1993 | Miyajima et al. |
| 5,304,410 | A | 4/1994 | Webster |
| 5,401,547 | A | 3/1995 | Blackwell et al. |
| 5,422,156 | A | 6/1995 | Billarant |
| 5,438,809 | A | 8/1995 | Ehrlich |
| 5,447,004 | A | 9/1995 | Vrnak |
| 5,522,187 | A | 6/1996 | Bogaerts |
| 5,564,251 | A | 10/1996 | Van Bers |
| 5,609,933 | A | 3/1997 | Stepanek |
| 5,634,309 | A | 6/1997 | Polen |
| 5,672,404 | A | 9/1997 | Callahan, Jr. et al. |
| 5,683,780 | A | 11/1997 | Rodger et al. |
| 5,691,027 | A | 11/1997 | Eckhardt et al. |
| 5,706,623 | A | 1/1998 | Brown |
| 5,761,765 | A | 6/1998 | Fuzzell |
| 5,822,828 | A | 10/1998 | Berard et al. |
| 5,834,081 | A | 11/1998 | Fanti |
| 5,863,632 | A | 1/1999 | Bisker |
| 5,888,335 | A | 3/1999 | Kobe et al. |
| 5,931,354 | A | 8/1999 | Braud et al. |
| 5,958,540 | A | 9/1999 | Berard et al. |
| 5,995,884 | A | 11/1999 | Allen et al. |
| 6,068,904 | A | 5/2000 | Stearns |
| 6,083,596 | A | 7/2000 | Pacione |
| 6,093,469 | A | 7/2000 | Callas |
| 6,216,315 | B1 | 4/2001 | Fuzzell |
| 6,253,526 | B1 | 7/2001 | Murphy et al. |
| 6,260,326 | B1 | 7/2001 | Muller-Hartburg |
| 6,306,477 | B1 | 10/2001 | Pacione |
| 6,333,073 | B1 | 12/2001 | Nelson et al. |
| 6,426,129 | B1 | 7/2002 | Kalwara et al. |
| 6,475,594 | B2 | 11/2002 | Johnston et al. |
| 6,599,599 | B1 | 7/2003 | Buckwater et al. |
| 6,694,682 | B2 | 2/2004 | Fanti |
| 6,701,685 | B2 | 3/2004 | Rippey |
| 6,756,100 | B2 | 6/2004 | Pearson et al. |
| 6,756,102 | B1 | 6/2004 | Galo |
| 6,803,090 | B2 | 10/2004 | Castiglione et al. |
| 6,841,216 | B2 | 1/2005 | Daniel et al. |
| 6,850,024 | B2 | 2/2005 | Peless et al. |
| 6,861,118 | B2 | 3/2005 | Kobayashi et al. |
| 6,888,459 | B2 | 5/2005 | Stilp |
| 6,908,656 | B2 | 6/2005 | Daniel et al. |
| 6,977,579 | B2 | 12/2005 | Gilfix et al. |
| 6,984,952 | B2 | 1/2006 | Peless et al. |
| 7,039,522 | B2 | 5/2006 | Landau |
| 7,148,803 | B2 | 12/2006 | Bandy |
| 7,225,980 | B2 | 6/2007 | Ku et al. |
| 7,242,303 | B2 | 7/2007 | Patel et al. |
| 7,245,215 | B2 | 7/2007 | Gollu et al. |
| 7,297,385 | B2 | 11/2007 | Daniel et al. |
| 7,339,523 | B2 | 3/2008 | Bye |
| 7,464,510 | B2 | 12/2008 | Scott et al. |
| 7,601,413 | B2 | 10/2009 | Daniel et al. |
| 7,672,780 | B2 | 3/2010 | Kim |
| 7,721,502 | B2 | 5/2010 | Scott et al. |
| 7,757,457 | B2 | 7/2010 | Zah et al. |
| 8,220,221 | B2 | 7/2012 | Gray et al. |
| 8,381,473 | B2 | 2/2013 | Scott et al. |
| 2003/0003263 | A1 | 1/2003 | Smith |
| 2003/0071051 | A1 | 4/2003 | Martinsen |
| 2003/0180091 | A1 | 9/2003 | Stridsman |
| 2004/0095244 | A1 | 5/2004 | Conwell et al. |
| 2004/0185682 | A1 | 9/2004 | Foulke et al. |
| 2004/0258870 | A1 | 12/2004 | Oakey et al. |
| 2005/0059308 | A1 | 3/2005 | Parsons |
| 2005/0089678 | A1 | 4/2005 | Mead |
| 2005/0099306 | A1 | 5/2005 | Gilfix et al. |
| 2005/0261571 | A1 | 11/2005 | Willis et al. |
| 2006/0048797 | A1 | 3/2006 | Jung et al. |
| 2006/0164236 | A1 | 7/2006 | Siegl et al. |
| 2006/0261951 | A1 | 11/2006 | Koerner et al. |
| 2006/0293794 | A1 | 12/2006 | Harwig et al. |
| 2007/0069021 | A1 | 3/2007 | Elrod et al. |
| 2009/0045918 | A1 | 2/2009 | Droesler et al. |
| 2009/0094919 | A1 | 4/2009 | Scott et al. |
| 2010/0024329 | A1 | 2/2010 | Gray et al. |
| 2010/0251641 | A1 | 10/2010 | Gallagher et al. |
| 2011/0061328 | A1 | 3/2011 | Sandy et al. |
| 2011/0107720 | A1 | 5/2011 | Oakey et al. |

FOREIGN PATENT DOCUMENTS

| | | | |
|---|---|---|---|
| AU | 2008230828 | A1 | 10/2008 |
| AU | 2011200866 | A1 | 3/2011 |
| AU | 2005295322 | B2 | 5/2011 |
| BR | PI 0313495-4 | A | 7/2005 |
| BR | PI 0518165-8 | A | 11/2008 |
| CA | 1287966 | | 8/1991 |
| CA | 2421763 | A1 | 3/2002 |
| CA | 2495101 | A1 | 2/2004 |
| CA | 2679004 | A1 | 10/2008 |
| CA | 2583532 | C | 7/2012 |
| CN | 2116040 | U | 9/1992 |
| CN | 101084350 | A | 12/2007 |
| CN | ZL200580042610.7 | | 9/2009 |
| CN | 101614066 | A | 12/2009 |
| CN | 101646737 | A | 2/2010 |
| CN | 200910164633.5 | B | 1/2013 |
| DE | 1913002 | A1 | 3/1970 |
| DE | 2027415 | A1 | 12/1971 |
| DE | 2304392 | A1 | 8/1973 |

| | | | |
|---|---|---|---|
| DE | 2649644 | A1 | 5/1978 |
| DE | 10001551 | A1 | 7/2001 |
| DE | 20111113 | U1 | 10/2001 |
| DE | 102004007595 | A1 | 9/2005 |
| EP | 0017986 | A1 | 10/1980 |
| EP | 0044533 | A1 | 1/1982 |
| EP | 0237657 | A1 | 9/1987 |
| EP | 0239041 | A2 | 9/1987 |
| EP | 0942111 | A1 | 9/1999 |
| EP | 1313079 | A2 | 5/2003 |
| EP | 2129735 | | 12/2009 |
| EP | 2258908 | A2 | 12/2010 |
| EP | 2258908 | A3 | 12/2010 |
| EP | 2258909 | A2 | 12/2010 |
| EP | 2258909 | A3 | 12/2010 |
| EP | 2374855 | A2 | 10/2011 |
| EP | 2374855 | A3 | 10/2011 |
| EP | 2374856 | A2 | 10/2011 |
| EP | 2374857 | A2 | 10/2011 |
| EP | 2374856 | A3 | 11/2011 |
| EP | 2374857 | A3 | 11/2011 |
| EP | 2417311 | | 2/2012 |
| EP | 2554616 | A2 | 2/2013 |
| FR | 1239859 | A | 8/1960 |
| FR | 2278876 | A | 2/1976 |
| FR | 2582210 | A1 | 11/1996 |
| FR | 2903707 | A1 | 1/2008 |
| GB | 1350767 | | 4/1974 |
| GB | 2113993 | A | 8/1983 |
| GB | 2182961 | A | 5/1987 |
| GB | 2299019 | A | 9/1996 |
| GB | 2342040 | A | 4/2000 |
| GB | 2389075 | A | 12/2003 |
| HK | 1114890 | B | 4/2010 |
| JP | 55086714 | A | 6/1980 |
| JP | 62010181 | A | 1/1987 |
| JP | H5163825 | | 6/1993 |
| JP | 7259305 | A | 10/1995 |
| JP | 09209545 | A | 8/1997 |
| JP | 09209546 | A | 8/1997 |
| JP | 09279106 | A | 10/1997 |
| JP | 11270115 | A | 10/1999 |
| JP | 2000328759 | A | 11/2000 |
| JP | 2001115631 | A | 4/2001 |
| JP | 2004003191 | A | 1/2004 |
| JP | 2005-538760 | A | 12/2005 |
| JP | 2008-517190 | A | 5/2008 |
| JP | 2010-523841 | A | 7/2010 |
| JP | 2011-94478 | A | 5/2011 |
| JP | 4945452 | | 3/2012 |
| KR | 10-2007-0068368 | A | 6/2007 |
| KR | 10-2010-0014594 | A | 2/2010 |
| MX | PA 03002223 | A | 6/2003 |
| MX | 285845 | | 4/2011 |
| NL | 1028881 | C2 | 10/2006 |
| WO | 9810688 | A1 | 3/1998 |
| WO | 9820330 | A1 | 5/1998 |
| WO | 9835276 | A1 | 8/1998 |
| WO | 0047837 | A1 | 8/2000 |
| WO | 0075417 | A1 | 12/2000 |
| WO | 0225004 | A2 | 3/2002 |
| WO | 02025004 | A3 | 7/2002 |
| WO | 03060256 | A1 | 7/2003 |
| WO | 2004016848 | A2 | 2/2004 |
| WO | 2004016848 | A3 | 5/2004 |
| WO | 2005071597 | A1 | 8/2005 |
| WO | 2005092632 | A1 | 10/2005 |
| WO | 2005112775 | A1 | 12/2005 |
| WO | 2005118273 | A1 | 12/2005 |
| WO | 2006044928 | A2 | 4/2006 |
| WO | 2006045819 | A2 | 5/2006 |
| WO | 2006065430 | A1 | 6/2006 |
| WO | 2006065839 | A2 | 6/2006 |
| WO | 2006066299 | A1 | 6/2006 |
| WO | 2006044928 | A3 | 8/2006 |
| WO | 2006096431 | A2 | 9/2006 |
| WO | 2006116528 | A2 | 11/2006 |
| WO | 2006128783 | A1 | 12/2006 |
| WO | 2007002708 | A1 | 1/2007 |
| WO | 2007018523 | A3 | 2/2007 |
| WO | 2007033980 | A3 | 3/2007 |
| WO | 2007072389 | A1 | 6/2007 |
| WO | 2007081823 | A2 | 7/2007 |
| WO | 2007098925 | A1 | 9/2007 |
| WO | 2008119003 | A2 | 10/2008 |
| WO | 2008119003 | A3 | 12/2008 |
| WO | 2010118084 | A2 | 10/2010 |
| WO | 2010144897 | A1 | 12/2010 |
| WO | 2010118084 | A3 | 3/2011 |

OTHER PUBLICATIONS

Amendment and Response to Apr. 19, 2007 Office Action, U.S. Appl. No. 11/018,947, Jul. 19, 2007, 11 pages.
Breaking New Ground in Flooring, TacFast Systems International website, www.tacfast.com, retrieved Mar. 3, 2004, 1 page.
Carpet Bargains, http://web.archive.org/web/19990827025011/carpetbargains.com/index.htm, retrieved Apr. 10, 2006, 2 pages.
Communication Pursuant to Article 94(3) EPC, EP Application No. 10180426.8, Sep. 7, 2011, 4 pages.
Communication Pursuant to Article 94(3) EPC, EP Application No. 08744428.7, Jan. 13, 2011, 5 pages.
Communication Pursuant to Article 94(3) EPC, EP Application No. 101804938, Nov. 10, 2011, 5 pages.
Communication Pursuant to Article 96(2) EPC, EP Application No. 01977126.0, Oct. 30, 2006, 3 pages.
Communication Pursuant to Rule 69 EPC and Invitation Pursuant to Rule 70a(1) EPC, EP Application No. 11172031.4, Nov. 14, 2011, 2 pages.
Communication Pursuant to Rule 69 EPC and Invitation Pursuant to Rule 70a(1) EPC, EP Application No. 10180426.8, Dec. 20, 2010, 2 pages.
Communication Pursuant to Rule 69 EPC and Invitation Pursuant to Rule 70a(1)EPC, EP Application No. 11172028.0, Nov. 7, 2011, 2 pages.
Communication Pursuant to Rule 69 EPC and Rule 70a(1)EPC, EP Application No. 11172023.1, Oct. 31, 2011, 2 pages.
Communication Pursuant to Rules 109 and 110 EPC, EP Application No. 03788382.4, Apr. 25, 2005, 2 pages.
Communication Pursuant to Rules 109 and 110 EPC, EP Application No. 01977126.0, May 9, 2003, 2 pages.
Communication Pursuant to Rules 161 and 162 EPC, EP Application No. 08744428.7, Nov. 3, 2009, 2 pages.
EP Extended European Search Report, EP Application No. 11172031.4, Oct. 10, 2011, 3 pages.
EP Rule 161(1) and 162 EPC Communication, EP Application No. 107147282, Dec. 1, 2011, 2 pages.
Examination, Prior Art and Voluntary Amendment, Canadian Patent Application No. 2,583,532, Jan. 17, 2008, 14 pages.
Examiner's First Report, Australian Patent Application No. 2005295322, Feb. 3, 2010, 2 pages.
Extended Search Report and Written Opinion, EP Application No. 10180426.8, Nov. 17, 2010, 6 pages.
Extended Search Report and Written Opinion, EP Application No. 11172023.1, Sep. 27, 2011, 6 pages.
Extended Search Report and Written Opinion, EP Application No. 11172028.0, Sep. 29, 2011, 5 pages.
Final Office Action, U.S. Appl. No. 12/573,960, Nov. 17, 2011, 9 pages.
Final Office Action, U.S. Appl. No. 10/638,878, Jan. 4, 2007, 7 pages.
First Office Action, Chinese Patent Application No. 2005800426107, Aug. 15, 2008, 18 pages.
First Office Action, Chinese Patent Application No. 2009101646335, May 10, 2010, 6 pages.
Fourth Office Action, Chinese Patent Application No. 2009101646335, Oct. 19, 2011, 3 pages, [no translation available].
International Preliminary Examination Report, PCT/US2003/025120, Dec. 28, 2004, 7 pages.
International Preliminary Report on Patentability, PCT/US2005/037507, Apr. 17, 2007, 13 pages.
International Preliminary Report on Patentability, PCT/US2005/018587, Nov. 29, 2006, 4 pages.

International Preliminary Report on Patentability with Written Opinion, PCT/US2010/038471, Dec. 12, 2011, 7 pages.
International Search Report, PCT/US2003/025120, Apr. 5, 2004, 3 pages.
International Search Report, PCT/US2005/18587, Sep. 9, 2005, 3 pages.
International Search Report, PCT/US2001/29313, Apr. 8, 2002, 4 pages.
Invitation to Pay Additional Fees, PCT/US2005/037507, Mar. 2, 2006, 9 pages.
Merchandising. Merriam-Webster Online Dictionary, http://webster.com/dictionary/merchandising, retrieved Apr. 10, 2006, 2 pages.
Notice of Acceptance, Australian Patent Application No. 2005295322, Nov. 23, 2010, 3 pages.
Notice of Allowance, Canadian Patent Application No. 2,583,532, Nov. 18, 2011, 1 page.
Notice of Allowance, Mexican Patent Application No. MX/a/2007/004405, Feb. 24, 2011, 1 page, [no translation available].
Notice of Allowance, U.S. Appl. No. 12/270,129, Oct. 17, 2011, 5 pages.
Notice of Allowance with Examiner's Amendment, U.S. Appl. No. 12/056,916, Apr. 26, 2010, 6 pages.
Notice of Allowance with Examiner's Amendment, U.S. Appl. No. 11/251,733, Jan. 11, 2010, 6 pages.
Notice of Grant of Patent Right for Invention, Chinese Patent Application No. 2005800426107, May 8, 2009, 4 pages.
First Office Action, Japanese Patent Application No. 2007537027, Sep. 14, 2010, 10 pages.
Office Action, U.S. Appl. No. 12/573,960, Mar. 7, 2011, 10 pages.
Final Office Action, Japanese Patent Application No. 2007537027, Aug. 9, 2011,10 pages.
Office Action, Mexican Patent Application No. MX/a/2007/004405, Oct. 6, 2010, 3 pages, [no translation available].
Second Office Action, Canadian Patent Application No. 2,583,532, Apr. 8, 2010, 3 pages.
First Office Action, Canadian Patent Application No. 2,583,532, May 13, 2009, 3 pages.
Communication Pursuant to Article 94(3) EPC, EP Application No. 05812737.4, Nov. 19, 2009, 3 pages.
Communication Pursuant to Article 94(3) EPC, EP Application No. 05812737.4, Nov. 28, 2008, 3 pages.
Office Action, U.S. Appl. No. 10/638,878, Apr. 27, 2006, 5 pages.
Communication Pursuant to Article 94(3) EPC, EP Application 05812737.4, Nov. 15, 2010, 5 pages.
Final Office Action, U.S. Appl. No. 12/702,509, Aug. 17, 2010, 6 pages.
Office Action, U.S. Appl. No. 10/381,025, Jan. 24, 2007, 8 pages.
Office Action, U.S. Appl. No. 11/251,733, Aug. 31, 2009, 6 pages.
Office Action, U.S. Reexamination Control No. 95/001,726, Nov. 10, 2011, 32 pages.
Office Action, U.S. Reexamination Control No. 95/001,725, Nov. 10, 2011, 46 pages.
Patent Owner's Response to Office Action in Inter Partes Reexamination with Exhibits A—J3, U.S. Reexamination Control No. 95/001,726, Mar. 9, 2012, 270 pages.
Patent Owner's Response to Office Action in Inter Partes Reexamination with Exhibits A—J3, U.S. Reexamination Control No. 95/001,725, Mar. 9, 2012, 280 pages.
Petition Under 37 C.F.R. § 1.91(a)(3) to Admit Non-Conforming Exhibits in an Inter Partes Reexamination, U.S. Reexamination Control No. 95/001,725, Mar. 9, 2012, 6 pages.
Petition Under 37 C.F.R. § 1.91(a)(3) to Admit Non-Conforming Exhibits in an Inter Partes Reexamination, U.S. Reexamination Control No. 95/001,726, Mar. 9, 2012, 6 pages.
Communication Proceeding Pursuant to Article 96(1) and Rule 51 (1) EPC, EP Application No. 019771260, Jun. 8, 2006, 3 pages.
Request for Inter Partes Reexamination, U.S. Reexamination Control No. 95/001,726 (Patent No. 7,721,502), Aug. 25, 2011, 162 pages.
Request for Inter Partes Reexamination, U.S. Reexamination Control No. 95/001,725 (Patent No. 7,464,510), Aug. 25, 2011, 169 pages.
Response to Aug. 15, 2008 First Office Action, Chinese Patent Application No. 2005800426107, Feb. 26, 2009, 27 pages, [translation of claims only].
Response to Apr. 16, 2010 Office Action, U.S. Appl. No. 12/702,509, Jun. 9, 2010, 4 pages.
Response to Apr. 25, 2005 Rule 109 Communication, EP Application No. 03788382.4, May 24, 2005, 9 pages.
Response to Apr. 27, 2006 Office Action, U.S. Appl. No. 10/638,878, Oct. 24, 2006, 7 pages.
Response to Apr. 5, 2011 Third Office Action, Canadian Patent Application No. 2,583,532, Sep. 29, 2011, 8 pages.
Response to Apr. 8, 2010 Second Office Action, Canadian Patent Application No. 2,583,532, Oct. 7, 2010, 14 pages.
Response to Aug. 31, 2009 Office Action, U.S. Appl. No. 11/251,733, Oct. 22, 2009, 9 pages.
Response to Aug. 9, 2011 Office Action, Japanese Patent Application No. 2007-537027, Dec. 9, 2011, 9 pages.
Response to Feb. 3, 2010 Examiner's First Report, Australian Patent Application No. 20050295322, Nov. 9, 2010, 17 pages.
Response to Aug. 17, 2010 Final Office Action, U.S. Appl. No. 12/702,509, Dec. 17, 2010, 5 pages.
Response to Mar. 7, 2011 Office Action, U.S. Appl. No. 12/573,960, Aug. 11, 2011, 11 pages.
Response to May 10, 2010 First Office Action, Chinese Patent Application Serial No. 2009101646335, Jul. 20, 2010, 9 pages, [translation of claims only].
Response to May 13, 2009 First Office Action, Canadian Patent Application No. 2,583,532, Nov. 13, 2009, 18 pages.
Response to May 25, 2011 Third Office Action, Chinese Patent Application Serial No. 2009101646335, Aug. 9, 2011, 12 pages, [translation of claims only].
Response to May 9, 2003 Communication Pursuant to Rules 109 and 110 EPC, EP Application No. 019771260, Jun. 6, 2003, 5 pages.
Response to Nov. 15, 2010 Communication Pursuant to Article 94(3) EPC, EP Application No. 05812737.4, May 13, 2011, 12 pages.
Response to Nov. 15, 2010 Extended European Search Report Pursuant to Rule 62 EPC , EP Application No. 10180493.8, Jun. 15, 2011, 55 pages.
Response to Nov. 17, 2010 Communication Pursuant to Rule 62 EPC, EP Application No. 101804268, Jun. 15, 2011, 54 pages.
Response to Nov. 28, 2007 Office Action, U.S. Appl. No. 11/018,947, Mar. 28, 2008, 15 pages.
Response to Oct. 4, 2010 Office Action, U.S. Appl. No. 12/573,960, Nov. 15, 2010, 9 pages.
Response to Oct. 6, 2010 Office Action, Mexican Patent Application No. MX/a/2007/004405, Dec. 9, 2010, 9 pages, [no translation available].
Response to Sep. 14, 2010 First Office Action, Japanese Patent Application No. 2007537027, Jan. 14, 2011, 8 pages, [no translation available].
Response to Sep. 2, 2009 Office Action, U.S. Appl. No. 12/270,129, Oct. 26, 2009, 9 pages.
Response to Sep. 29, 2009 Communication Pursuant to Rule 161EPC, EP Application No. 08744428.7, Dec. 11, 2009, 21 pages.
Response to Sep. 9, 2010 Second Office Action, Chinese Patent Application No. 2009101646335, Oct. 14, 2010, 9 pages, [translation of claims only].
Second Office Action, Chinese Patent Application No. 2009101646335, Sep. 9, 2010, 8 pages.
Summons to Attend Oral Proceedings Pursuant to Rule 115(1) EPC, EP Application No. 058127374, Nov. 15, 2011, 4 pages.
Supplemental Notice of Allowability, U.S. Appl. No. 12/270,129, Nov. 17, 2011, 2 pages.
Supplemental Petition Under 37 C.F.R. § 1.183 to Exceed the Page Limit for Patent Owner's Response in an Inter Partes Reexamination, U.S. Reexamination Control No. 95/001,725, Mar. 9, 2012, 4 pages.
Supplemental Petition Under 37 C.F.R. § 1.183 to Exceed the Page Limit for Patent Owner's Response in an Inter Partes Reexamination, U.S. Reexamination Control No. 95/001,726, Mar. 9, 2012, 4 pages.
Supplementary European Search Report, EP Application No. 01977126.0, May 18, 2006, 3 pages.
Third Office Action, Canadian Patent Application No. 2,583,532, Apr. 5, 2011, 2 pages.
Third Office Action, Chinese Patent Application No. 2009101646335, May 25, 2011, 5 pages, [no translation available].

Voluntary Amendment, Brazilian Patent Application No. PI0313495-4, Feb. 23, 2006, 16 pages, [no translation available].
Voluntary Amendment, Australian Patent Application No. 2003265409, Apr. 11, 2005, 20 pages.
Voluntary Amendment, Korean Patent Application No. 1020077008403, Oct. 15, 2010, 44 pages, [translation of claims only].
Voluntary Amendment, Japanese Patent Application No. 2004-529303, Aug. 3, 2005, 5 pages, [no translation available].
Voluntary Amendment, Canadian Patent Application No. 2,495,101, Feb. 9, 2005, 6 pages.
Voluntary Amendment, Chinese Patent Application No. 2005800426107, Oct. 12, 2007, 9 pages, [no translation available].
Voluntary Amendment, Brazilian Patent Application No. PI0518165-8, Oct. 17, 2008, 43 pages, [no translation available].
WOLFF TFV Carpet Tile Connector, WOLFF GmbH, WOLFF TFV Carpet Tile Connector, WOLFF GmbH, 1987, 2 pages.
Written Opinion, PCT/US2005/018587, Sep. 9, 2005, 3 pages.
Written Opinion, PCT/US2003/025120, Oct. 8, 2004, 6 pages.
Response to Nov. 28, 2008 94(3) EPC Communication, EP Application No. 05812737.4, May 29, 2009, 75 pages.
Response to Nov. 19, 2010 Communication Pursuant to Article 96(2) EPC, EP Application No. 05812737.4, May 20, 2010, 64 pages.
Notice of Allowance with Examiner's Amendment, U.S. Appl. No. 11/018,947, Aug. 13, 2008, 7 pages.
Office Action, U.S. Appl. No. 11/018,947, Nov. 28, 2007, 12 pages.
Office Action, U.S. Appl. No. 11/018,947, Apr. 19, 2007, 6 pages.
Notice of Allowance, U.S. Appl. No. 12/270,129, Sep. 29, 2010, 4 pages.
Office Action, U.S. Appl. No. 12/270,129, Sep. 2, 2009, 5 pages.
Office Action, U.S. Appl. No. 12/573,960, Oct. 4, 2010, 7 pages.
Office Action, U.S. Appl. No. 12/702,509, Apr. 26, 2010, 6 pages.
Final Office Action, U.S. Appl. No. 12/702,509, Aug. 17, 2010, 8 pages.
El-Zabadani, Hicham et al., A Mobile Sensor Platform Approach to Sensing and Mapping Pervasive Spaces and Their Contents, University of Florida, Mobile & Pervasive Computing Laboratory, CISE Dept., Date Unknown, 14 pages.
International Search Report and Written Opinion, PCT/US2005/037507, May 31, 2006, 19 pages.
International Preliminary Report on Patentabilty, PCT/US2008/058361, Nov. 8, 2009, 11 pages.
International Search Report and Written Opinion, PCT/US2008/058361, Nov. 7, 2008, 18 pages.
International Preliminary Report on Patentability, PCT/US2010/030170, Oct. 20, 2011, 11 pages.
International Search Report and Written Opinion, PCT/US2010/030170, Jan. 5, 2011, 17 pages.
International Search Report and Written Opinion, PCT/US2010/038471, Sep. 6, 2010, 11 pages.
Response to Oct. 19, 2011 Fourth Office Action, Chinese Patent Application Serial No. 2009101646335, Mar. 5, 2012, 16 pages, [translation of claims only].
Final Office Action, U.S. Appl. No. 12/573,960, Mar. 15, 2012, 10 pages.
Response to Sep. 7, 2011 Communication Pursuant to Article 94(3) EPC, EP Application No. 10180426.8, Mar. 7, 2012, 21 pages.
Communication Pursuant to Rules 109 and 110 EPC, EP Application No. 05812737.4, May 25, 2007, 2 pages.
Notice of Publication of the Registration and Grant of a Standard Patent, Hong Kong Application No. 08104813.9, Apr. 1, 2010, 1 page.
Notice of Allowance with Examiner's Amendment, U.S. Appl. No. 12/702,509, Mar. 19, 2012, 8 pages.
Decision to Grant Patent, Japanese Patent Application No. 2007537027, Feb. 7, 2012, 6 pages.
Amendment to Response to Sep. 7, 2011 Communication Pursuant to Article 94(3) EPC, EP Application No. 10180426.8, Mar. 19, 2012, 57 pages.
Comments of Requester, Tandus Flooring, Inc., U.S. Reexamination Control No. 95/001,726, Apr. 6, 2012, 37 pages.
Comments of Requester, Tandus Flooring, Inc., U.S. Reexamination Control No. 95/001,725, Apr. 6, 2012, 37 pages.
Communication Regarding Summons to Attend Oral Proceedings, EP Application No. 05812737.4, Mar. 26, 2012, 2 Pages.
Response to Communication Pursuant to Rule 62 EPC and Request for Examination, EP Application No. 11172028.0, Mar. 29, 2012, 102 pages.
Response to Communication Pursuant to Rule 62 EPC and Request for Examination, EP Application No. 11172031.4, Mar. 29, 2012, 152 pages.
Fifth Office Action, Chinese Patent Application No. 2009101646335, Mar. 27, 2012, 6 pages, [partial translation].
Amendment, U.S. Appl. No. 12/270,129, Apr. 17, 2012, 13 pages.
Second Preliminary Amendment, U.S. Appl. No. 12/270,129, May 14, 2012, 12 pages.
First Office Action, Chinese Patent Application No. 200880010206.5, Mar. 27, 2012, 23 pages.
Response to Mar. 27, 2012 Fifth Office Action, Chinese Patent Application No. 2009101646335, Jun. 11, 2012, 8 pages, [translation of claims only].
Response to Final Office Action Accompanying Request for Continued Examination, U.S. Appl. No. 12/573,960, Jun. 15, 2012, 9 pages.
Response to Dec. 1, 2011 Rule 161(1) EPC and 162 EPC Communication, European Patent Application No. 10714728.2, Jun. 11, 2012, 17 pages.
Notice of Allowance, U.S. Appl. No. 12/270,129, Mar. 21, 2012, 5 pages.
Declaration of David Oakey with Exhibits 1-22, Apr. 2012, 55 pages.
Notice of Allowance with Examiner's Amendment, U.S. Appl. No. 12/270,129, Jun. 29, 2012, 7 pages.
Communication Pursuant to Article 94(3) EPC, European Patent Application No. 11172031.4, Jun. 25, 2012, 4 pages.
Communication Pursuant to Article 94(3) EPC, European Patent Application No. 11172028.0, Jun. 14, 2012, 4 pages.
Response to Mar. 27, 2012 First Office Action, Chinese Patent Application No. 200880010206.5, Aug. 10, 2012, 20 pages, [translation of claims only].
Action Closing Prosecution, U.S. Reexamination Control No. 95/001,726, Aug. 28, 2012, 57 pages.
Action Closing Prosecution, U.S. Reexamination Control No. 95/001,725, Aug. 28, 2012, 56 pages.
Notice of Preliminary Rejection, Korean Application No. 10-2007-7008403, Aug. 10, 2012, 4 pages.
Notice of Allowance, U.S. Appl. No. 12/270,129, Oct. 11, 2012, 17 pages.
Amendment Accompanying Request for Continued Examination, U.S. Appl. No. 12/270,129, Sep. 26, 2012, 13 pages.
Response to Jun. 25, 2012 Communication Pursuant to 94(3)EPC, EP Application No. 11172031.4, Oct. 24, 2012, 7 pages.
Response to Jun. 14, 2012 Communication Pursuant to 94(3)EPC, EP Application No. 11172028.0, Oct. 4, 2012, 72 pages.
Notification to Grant Patent Right of Invention, Chinese Patent Application No. 200910164633.5, Aug. 31, 2012, 5 pages.
Patent Owners Amendment and Comments in Response to Action Closing Prosecution in Inter Partes Reexamination, U.S. Reexamination Control No. 95/001,726, Sep. 28, 2012, 14 pages.
Comments of Requester Tandus Flooring, Inc., U.S. Reexamination Control No. 95/001,726, Oct. 26, 2012, 9 pages.
Office Action, U.S. Appl. No. 12/814,654, Oct. 12, 2012, 7 pages.
Amendment and Response to Aug. 10, 2012 Office Action, Korean Application No. 10-2007-7008403, Oct. 10, 2012, 9 pages, [translation available].
Second Office Action, Chinese Patent Application No. 200880010206.5, Oct. 12, 2012, 7 pages, [partial translation only].
Patent Owners Amendment and Comments in Response to Action Closing Prosecution in Inter Partes Reexamination, U.S. Reexamination Control No. 95/001,725, Sep. 28, 2012, 14 pages.
Comments of Requester Tandus Flooring, Inc., U.S. Reexamination Control No. 95/001,725, Oct. 26, 2012, 9 pages.
Office Action, U.S. Appl. No. 12/573,960, Oct. 16, 2012, 9 pages.
Response to Office Action, U.S. Appl. No. 12/814,654, Jan. 14, 2013, 7 pages.
First Office Action, Japanese Patent Application No. 2010-501209, Dec. 19, 2012, 6 pages.

Right of Appeal Notice, U.S. Reexamination Control No. 95/001,725, Jan. 23, 2013, 90 pages.
Office Action, U.S. Appl. No. 12/754,994, Nov. 26, 2012, 85 pages.
Response to Non-Final Office Action, U.S. Appl. No. 12/573,960, Jan. 16, 2013, 7 pages.
Summons to Attend Oral Hearing Pursuant to Rule 115(1) EPC, EP Application No. 10180493.8, Dec. 3, 2012, 8 pages.
Response to Nov. 15, 2011 Communication Pursuant to Rule 115(1) EPC and Rule 116EPC, EP Application No. 058127374, 88 pages.
First Office Action, Japanese Patent Application No. 2011-6501, Dec. 19, 2012, 6 pages.
Second Office Action, Chinese Patent Application No. 200880010206.5, Oct. 12, 2012, 9 pages.
Summons to Attend Oral Hearing Pursuant to Rule 115(1) EPC, EP Application No. 10180426.8, Oct. 10, 2012, 8 pages.
Right of Appeal Notice, U.S. Reexamination Control No. 95/001,726, Dec. 12, 2012, 51 pages.
Notice of Appeal by Patent Owner, U.S. Reexamination Control No. 95/001,726, Jan. 14, 2013, 5 pages.
Notice of Allowance with Examiner's Amendment, U.S. Appl. No. 12/573,960, Feb. 28, 2013, 10 pages.
Decision to Refuse a European Patent Application, EP Application No. 058127374, Feb. 20, 2013, 37 pages.
Provision of a Copy of the Minutes in Accordance with Rule 124(4)EPC, EP Application No. 058127374, Feb. 18, 2013, 20 pages [best available copy].
Appeal Brief of Patent Owner in *Inter Partes* Reexamination with Exhibits A-K, Related Proceedings Appendix, Claims Appendix and Evidence Appendix, U.S. Appl. No. 95/001,726, Mar. 14, 2013, 303 pages.
Petition Under 37 C.F.R. § 1.183 to Exceed the page Limit for Patent Owner's Appeal Brief in an *Inter Partes* Reexamination, U.S. Appl. No. 95/001,726, Mar. 14, 2013, 4 pages.
Notice of Appeal by Patent Owner, U.S. Appl. No. 95/001,725, Feb. 25, 2013, 5 pages.
Notice of Allowance, U.S. Appl. No. 12/814,654, Feb. 28, 2013, 13 pages.

SYSTEM FOR CARPET TILE INSTALLATION

RELATED APPLICATION DATA

This application is a continuation of U.S. patent application Ser. No. 12/270,129 filed Nov. 13, 2008, allowed, which is a continuation of U.S. patent application Ser. No. 11/018,947 filed Dec. 21, 2004, now U.S. Pat. No. 7,464,510, which claims the benefit of U.S. Provisional Application No. 60/619,340, filed Oct. 15, 2004, and is a continuation-in-part of U.S. patent application Ser. No. 10/638,878, filed Aug. 11, 2003, which claims the benefit of U.S. Provisional Application No. 60/403,790, filed Aug. 15, 2002, which and is a continuation-in-part of U.S. patent application Ser. No. 10/381,025, filed Dec. 8, 2003, which is a 35 U.S.C. 371 national phase of PCT/US01/29313, filed Sep. 19, 2001, which claims the benefit of U.S. Provisional Application No. 60/233,680, filed Sep. 18, 2000, all of which applications are incorporated herein by reference in their entirety.

FIELD OF THE INVENTION

This invention relates to systems and methods for installing floor coverings, particularly including carpet tile and other modular floor coverings.

BACKGROUND OF THE INVENTION

Floor coverings have been in use since before recorded human history. The first such materials were undoubtedly animal skins or plant materials like leaves or stems. Later, floor coverings were manufactured, such as by weaving or knotting a variety of naturally occurring fibers, including sisal and wool. Beginning in the twentieth century, such fiber-faced floor coverings began to be manufactured from man-made fibers as well.

While the first floor coverings were limited in size to the size of an animal skin, later floor coverings expanded to cover entire room floors. Such "wall-to-wall" installations of "broadloom" floor covering came into wide-spread use in the twentieth century. Paradigm installations of such materials utilize one or a small number of pieces of broadloom carpeting to cover entire room floors. This type of wall-to-wall floor covering is generally attached to the floor in some manner.

Later, modular floor coverings utilized smaller, uniform size modules or tiles in both solid surface floor coverings such as vinyl tiles and in textile-faced floor coverings, usually called carpet tiles. As explained in U.S. patent application Ser. No. 10/638,878 for "Re-Configurable Modular Floor Covering," filed Aug. 11, 2003, tiles may be installed, as area rugs that do not cover the entire flooring surface. However, the vast majority of tiles are used in wall-to-wall installations. Tiles have traditionally been installed in aligned rows and columns, with the edges of each tile aligned with the edges of adjacent tiles ("conventional carpet tile installation method"). Conventional carpet tile has historically been a product that sought to mimic the appearance of broadloom carpet and to hide or at least de-emphasize the fact that the product was modular. Achieving this result has required, at minimum, that carpet tiles or modules be placed in a flooring installation with the same orientation that the modules had at the time they were produced (i.e., monolithically). However, textile face modular flooring designers have recently begun to design flooring and flooring installations that do not seek to mask, but rather celebrate, the modularity of the flooring. For instance, while still installed in aligned rows and columns, modules are installed "quarter-turned" with each tile position rotated 90° relative to each adjacent tile.

Modules are not always installed in aligned rows and columns, however. For example, tiles are also installed in aligned columns that do not form aligned rows of modules so that a column of tiles appears shifted up or down relative to adjacent tile columns ("ashlar installation method"). In other installations, tiles are installed in aligned rows that do not form aligned, but rather staggered, columns ("brick-laid installation method").

While the floor covering modules are generally of relatively substantial size and weight, which facilitates maintenance of the modules in the positions they are placed when the floor covering is assembled, it is desirable to provide a means for further resisting module movement. This has traditionally been accomplished by attaching the modules to the underlying flooring surface in a variety of ways.

Modules are often glued to the floor by first applying a layer of adhesive to the underlying flooring surface and then positioning the tiles on top of the adhesive. With this method, adhesive typically contacts the entire surface area of the underside of the flooring modules, which increases material costs and often leads to difficultly in re-positioning the tiles if they are positioned incorrectly. This is a particular problem during installation of patterned modules that must be matched at the seams. Moreover, when the tiles are eventually removed, glue remains on the flooring surface and that glue sometimes retains portions of the removed tiles. The glue (and any flooring materials held by the glue) must be removed from the floor to create a smooth surface before installing new tiles. This adds both cost and time to the installation process.

Modules may also be installed by pre-applying adhesive to the entire underside (or any part) of the module. For example, adhesive may be applied in a relatively narrow strip across each module underside and covered, prior to module installation, by a plastic film or paper strip that is peeled off just before module placement. Again, however, this method involves attaching the modules directly to the floor and can result in the consequent drawbacks discussed above.

Modules have also be installed using double-sided adhesive tape, whereby one side of the tape is positioned on the back of the module and the other side of the tape is positioned on the floor to thereby secure the module to the floor. Double-sided tape has also been positioned between and along the entirety of adjacent carpet and carpet tile edges. However, as with adhesive, double sided tape can be unforgiving with respect to tile re-positioning and can also leave a residue on the floor upon removal of the tiles. Moreover, the tape has a low tensile strength and is relatively inelastic and consequently is apt to stretch and not regain its shape. This can result in the gaps formed between adjacent tiles.

In addition to direct attachment to the floor, modules have also been indirectly attached to the underlying flooring surface, such as with mechanical fasteners or adhesive covered pads. For example, hook and loop fasteners have been used whereby a sheet of either the hook or the loop is secured to the floor and the other of the hook or the loop is provided on the back of the modules. The hook or loop on the modules then engages the hook or loop on the floor to secure the modules to the floor. Pads covered with adhesive have also been used. For example, a foam pad pre-coated on both sides with a releasable adhesive has been used. During installation, release paper is removed from both sides of the pad to expose the adhesive, and the pad is attached to the floor. Carpet tiles are then positioned on top of the pad and held in place by the adhesive. While these systems and methods may improve the installers' ability to re-position the tiles, they significantly increase the material cost of the installation. Moreover, with these installation methods, the tiles are more likely to move relative to each other and thereby create gaps in the installation.

Other installation methods exist whereby the tiles are neither directly nor indirectly attached to the floor. For example, one-sided adhesive tape, such as duct tape, has been used to secure adjacent tiles together. The tiles are positioned face down and the tape is secured along the entirety of the adjacent edges of the tiles. The tiles must then be carefully turned over to expose their wear surfaces without breaking the connection between adjacent tiles. This method requires a significant amount of time to position the tape on the tiles as well as a significant material investment to tape adjacent tile edges together along the entirety of the seams. Moreover, such adhesive tape is relatively flimsy, making it challenging to position the tape as desired on the underside of tiles, and, as with double-sided adhesive tape, suffers from low tensile strength and inelasticity, rendering it likely to permanently stretch when subjected to stress and thereby create permanent gaps between adjacent tiles.

While methods for installing floorcoverings exist, a need exists for a system and method that reduces both the time and material costs needed to install modules into a stable floorcovering.

SUMMARY OF THE INVENTION

This invention addresses the problems of previous modular flooring installation methods by providing systems and methods that reduce the time and material costs required to install a floor covering. Connectors are used to join adjacent floor covering units. The connectors are particularly useful in installing modular floor covering units ("tiles"). Each connector includes a film and an adhesive layer coated on one side of the film. To install tiles using the connectors, a first tile is placed on the floor at a position determined by conventional tile installation methods. A connector is positioned so that the adhesive layer faces upward and does not contact the floor. The connector is typically positioned so that only a portion of the adhesive layer adheres to the underside of the tile, leaving the remainder of the connector extending from the underside of the tile. Tiles are then positioned adjacent the first tile so that a portion of the connector adheres to the adjacent tiles. In this way, the connectors span the adjacent edges of the adjacent tiles. The tiles are assembled on a underlying floor surface without the need to attach them to the floor surface. Rather, the tiles are linked to each other with the connectors, so that the tiles create a floor covering that "floats" on the underlying floor surface.

The connectors need not be positioned along the entirety of the adjacent edges nor even across all adjacent tiles edges in the installation. Rather, the connectors are sized so that, when positioned in the installation, they do not extend along the entire length of the adjacent edges. Moreover, while any number of connectors may be used at any number of locations between adjacent tiles, the benefits of this invention may be fully realized by placing the connectors in strategic locations within the assembly (such as at some of the corners where four tiles meet). This is in contrast to prior installation methods that required stabilizing material be placed along the entirety of adjacent tiles edges so that all adjacent tiles edges in the installation were stabilized.

The size and relatively minimal number of connectors needed to stabilize a tile installation can result in a significant reduction in material costs from prior tile installation methods. Moreover, use of the connectors significantly reduces tile installation time by obviating the need to prep a floor prior to installation instead of the installer applying a layer of adhesive to the floor and then retracing his steps to position the tiles on the adhesive layer, with the connectors, the installer positions and secures as he goes. Moreover, given the releasable adhesive used on the connectors and the limited surface area of the tiles that contacts the connectors, the tiles can easily be re-positioned if necessary. Furthermore, because the tiles do not interact with the underlying floor, they are easily removable from the floor and leave the underlying floor pristine upon such removal. Consequently, the floor does not require refinishing before it is recovered with another floorcovering.

DETAILED DESCRIPTION OF THE DRAWINGS

This invention relates to systems and methods for installing floor covering. One of skill in the art will understand that the systems and methods described herein may be used in a variety of floor covering installations. However, applicants have found the connectors described herein particularly useful in any type installation (including wall-to-wall and area rug installations) of modular floor covering units (hereinafter referred to as "tiles"). The tiles may be of various colors and textures in a range of sizes and shapes. For example, individual tiles may be in a shape that simulates wood planking or shapes of ceramic and other tiles, including, but not limited (o, hexagons, squares, rectangles, triangles and other shapes. In addition, the tiles may be provided in a variety of textures. Tiles of this invention may typically be conventional carpet tile with textile faces (including, but not limited to, tufted, bonded, and printed faces), but could also be other modular materials, including woven and nonwoven textile flooring, solid vinyl, ceramics, leather, or any other suitable material. The tiles are preferably installed on a generally smooth surface, including, but not limited to plywood, laminates, linoleum, vinyl tile, hardwoods, and concrete. However, as discussed below, the tiles may be installed on an intermediate substrate, including pad and broad loom carpet, located between the tiles and the underlying floor.

Figure 1:
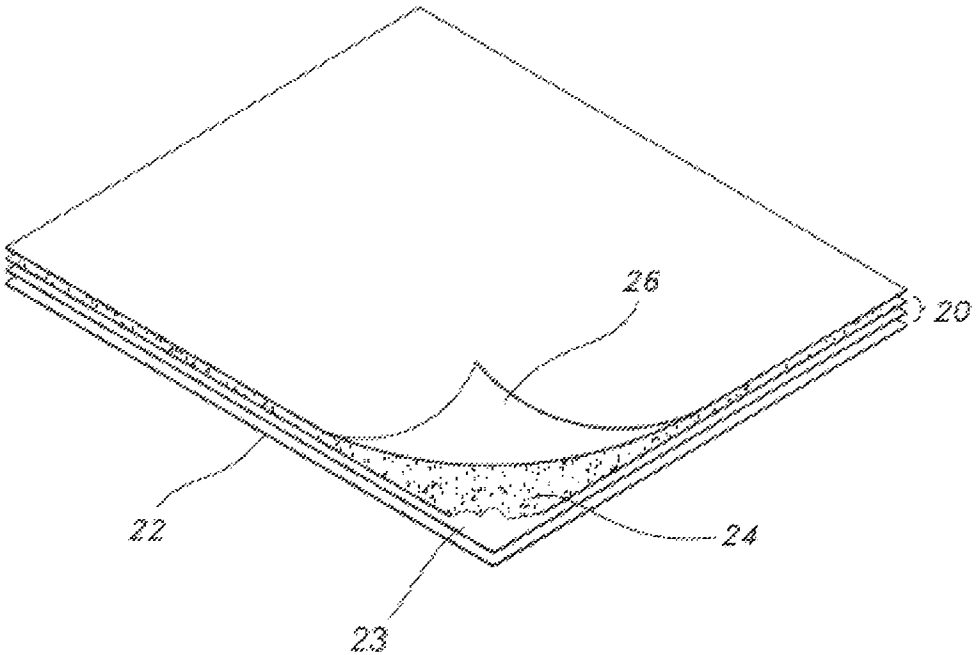
FIG. 1 is perspective view of one embodiment of a connector and release layer of this invention.

FIG. 1 illustrates one embodiment of a connector 20 of this invention. The connector 20 includes a film 22 and an adhesive layer 24 coated on one side of the film 22. A release layer 26 is placed on top of the adhesive layer 24 to protect the underlying adhesive. In use, the release layer 26 is removed from the connector 20 to expose the adhesive layer 24. As will be described in more detail below, the connector 20 is then positioned so that the adhesive layer 24 contacts the underside of adjacent tiles to span the adjacent edges of the tiles and thereby connect the tiles together to form a floor covering. In this way, the tiles are assembled on a underlying flooring surface without the need to attach them to the floor surface, so that the tiles create a floor covering that "floats" on the underlying floor surface.

The film 22 may be of any suitable material, but, to facilitate rapid flooring installations in accordance with this invention, is preferably made of a material that is relatively stiff so that a connector positioned partly in contact with the underside of a tile will project beyond the edge of the tile in roughly the same plane as the underside of the tile. This facilitates proper positioning of the projecting connector portion to make appropriate contact with an adjacent tile. This is typically greater stiffness than most adhesive tapes that will significantly curl or droop down from an underside of a tile to which a portion (but not all) of a length of such adhesive tape is attached. At the same time, the film 22 from which connectors of this invention are made should be sufficiently flexible to facilitate handling the connectors in a roll if desired and to permit the connectors to conform to floor or tile irregularities.

The film 22 should also resist shrinkage, which can result in buckling of adjacent tiles, and exhibit a relatively high tensile strength to resist stretching under foot traffic and rolling loads. For example, materials that exhibit a tensile strength between 160-270 mega Pascals ("MPa") in the machine direction and 165-210 MPa in the cross-machine direction have been found particularly suitable for this application. Moreover, the percentage by which the material may be elongated or stretched before breaking should also be relatively high to prevent connector breakage and failure when subjected to tensile stresses. For example, it is preferable, but not required, that the material used be capable of being stretched 120-200% of its machine direction dimension and 150-170% of its cross-machine direction dimension before breaking.

Polymeric materials, paperboard and other materials including textiles and metals that are suitably stiff, thin, strong, water-resistant and inexpensive may also be used for film 22. However, the film 22 is preferably a synthetic polymer material, such as a polyolefin, a polyamide, or a polyester, and more preferably polyethylene terephthalate ("PET") polyester. These materials are relatively cheap, will conform to the underlying floor in use, and will resist corrosion. While not necessary, it is preferable that the film material be recyclable.

The film 22 preferably has a thickness between 0.0005 and 0.015 inches, inclusive, and more preferably between 0.003 and 0.01 inches, inclusive, and even more preferably is 0.005 inches. The film 22 may also have, but does not have to have, a primer coat (not shown in the figures), such as a coating of acrylic, applied to the same side on which the adhesive layer 24 is to be applied to promote adhesion between the film 22 and the adhesive layer 24. The film 22 may be corona treated on one or both sides to increase surface tension and promote adhesion between the film 22 and the adhesive 24 without the use of adhesion promoting coatings.

The film 22 may be any shape, including, hut not limited to, a circular shape or any rectilinear shape such as a square or triangular. A square shape is suitable for most installations. Moreover, the size of the film 22 can depend on the size of the tiles being installed. However, as a general e, the surface area of the film 22 can be as little as 1%, and preferably between 2-5%, of the surface area of the tiles for which the connectors are intended to be installed. It has been found that a connect surface area over nine square inches does not meaningfully contribute to the stability of an installation of 18 inch square or 50 centimeter square tiles. Thus, connectors 20 desirably should be, but do not have to be, no larger than about three inches by three inches square to conserve materials and limit expense.

While the adhesive layer 24 can be any adhesive that exhibits certain attributes desirable for use in this invention, the specific type or amount of adhesive used in the connector may often depend on the tile with which the connector 20 is intended for use. With all tiles, however, it is preferable to use a releasable adhesive. Water-based adhesives rather than solvent based adhesives) with little or no volatile organic content ("VOC") are also preferable. Acrylic adhesives, including those sold by 3M under the identification numbers 9465, 6032, 6035, and 6038, and in particular 9465 (which is primarily an acrylate terpolymer) and 6032 (a tackified acrylate copolymer), are suitable. Moreover, the adhesive 24 preferably, but not necessarily, is resistant to water and typical carpet cleaning detergents.

The adhesive layer 24 in all connectors 20 should adhere well to the back of the tiles. However, the adhesion to the tile should not be so strong as to prevent removal and repositioning of the tile relative to the connector 20, if necessary. If the bond strength between the tile and the adhesive (i.e., the amount of force required to separate the adhesive layer 24 from the tile hacking, which can be measured using the ASTM D-3330 test (commonly referred to as the "90 degree peel test")) is too strong, the adhesive layer 24 will peel from the film and remain with the tile, thereby destroying the connector. Thus, the bond strength between the adhesive layer 24 and the tile should not be stronger than that between the adhesive layer 24 and the film 24.

The bond strength is preferably between 5-100 ounces/inch, inclusive, at room temperature. The preferable bond strength may depend on the tile backing. For example, the bond strength between the adhesive and hardback tiles, such as, for example, those made from PVC, polyurethane, or polyolefin, is preferably about 50-70 ounces/inch. The bond strength between the adhesive and tiles having a textile backing, such as for example a woven polypropylene or felt backing, is preferably about 10-60 ounces/inch. Moreover, the bond strength between the adhesive and cushion back tiles is preferably about 40-60 ounces/inch, and the bond strength between the adhesive and bitumen backed tiles is preferably about 10-20 ounces/inch. It is preferable that the bond strength between a tile and the adhesive at elevated temperatures remain within +/−15% of the bond strength at room temperature.

The amount of adhesive (i.e., the thickness of the adhesive layer) provided on each connector 20 can depend both on the size of the connector 20 as well as the tile to be used with the connector 20. However, it is preferable that, while the amount of adhesive should enable the connector sufficiently to contact and engage the underside of the tile to achieve the bonding strengths set forth above, it should not be so much that the adhesive migrates beyond the interface of the connector 20 and tile to contact the underlying floor. In this way, the floor-covering installation will remain unsecured to the underlying floor to facilitate the eventual removal of the modular units. A connector 20 with an adhesive thickness about 0.0005-0.010 inches, and more preferably about 0.002-0.008 inches, has been found suitable for most applications.

For tiles having a textile backing, more adhesive will typically be necessary to penetrate the cavities formed in the backing and thereby provide sufficient interfacial contact between the tile and adhesive. Connectors having an adhesive layer 24 that is about 0.005-0.008 inches thick is preferable for tiles having textile backings. For tiles having a relatively flat or shallow embossed backing surface, such as hard back tiles, less adhesive, preferably with a thickness in the range of 0.002-0.003 inches, may be used.

All of the adhesives contemplated for use on the connectors should also have sufficient sheer strength to prevent the tiles from moving relative to the connectors or each other and thereby creating gaps between adjacent tiles after installation.

Although not shown in the figures, it is possible to provide a logo or other design elements on the connectors 20. For example, a logo may be inked on the side of the film on which the adhesive is to be applied. In this way, the ink, which typically has a high VOC content, is trapped between the film and the adhesive, preventing any undesirable emissions from the ink. Moreover, when the connector is positioned on the release paper, the logo is also protected by the film. This prevents the logo from being accidentally scratched off or otherwise removed from the connector.

The release layer 26 may be any material compatible with the adhesive such that the release layer 26 does not adhere to the adhesive to prevent its removal from the connector. Kraft paper having a low energy coating, such as a polymer coating (e.g., polymeric silicone), on at least one side has been found to be particularly suitable in this application. However, release materials suitable for use in this invention are widely commercially available, such as from 3M, and readily known to one of ordinary skill in the art.

The connectors 20 are preferably provided to the installation site as individual units already entirely or partially cut into the desired shape and size to be used in the installation. While each connector 20 may be manufactured separately, economies of manufacture may be achieved by first manufacturing a sandwich of film 22, adhesive layer 24, release layer 26 larger than the intended connector size, and then cutting the connectors 20 from that sandwich. The adhesive layer 24 can be coated onto the desired film 22, after which the release layer 26 is positioned in contact with the adhesive layer 24 to form the sandwich. In another manufacturing embodiment, the adhesive layer 24 is first applied to the release layer 26, after which the film 22 is positioned onto the release layer 26 to form the sandwich.

The resulting sandwich may obviously then be cut into connectors 20 of the desired shape and size. However, a number of connectors 20 is preferably provided on a single release layer 26. For example, multiple pre-cut or perforated connectors 20 may be positioned consecutively along a strip of release layer 26. For ease of handling and storage, this strip can be rolled so that the connectors are positioned on the outside (see FIG. 2) or inside of the roll or folded between consecutive connectors 20 into an accordion shape. Moreover, a number of connectors 20 may be provided on a sheet of release layer 26. The film 22 may be provided with perforations 28 (see FIG. 3) or may be fully cut into the desired connector shape and size for ease of removal from the release layer 26 (not shown) during installation. The ideal number of connectors 20 provided on a strip or sheet of release material will obviously vary depending on the size of the installation.

Figure 2:
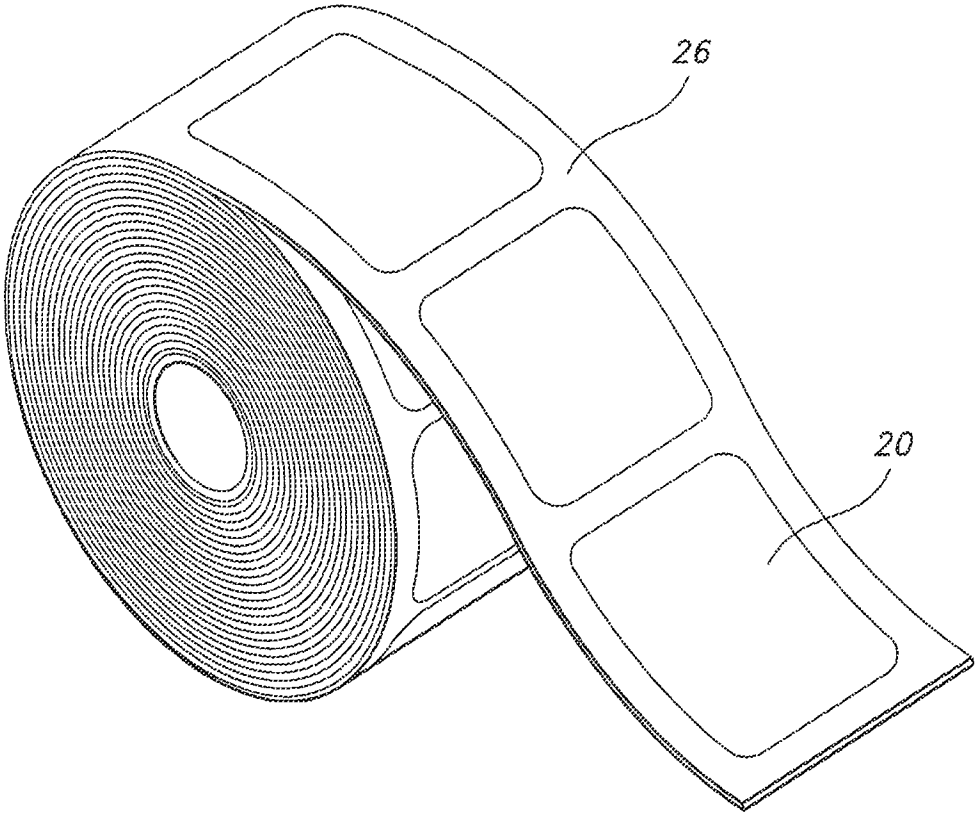
FIG. 2 is a perspective view of another embodiment of connectors and a release layer of this invention.
Figure 3:
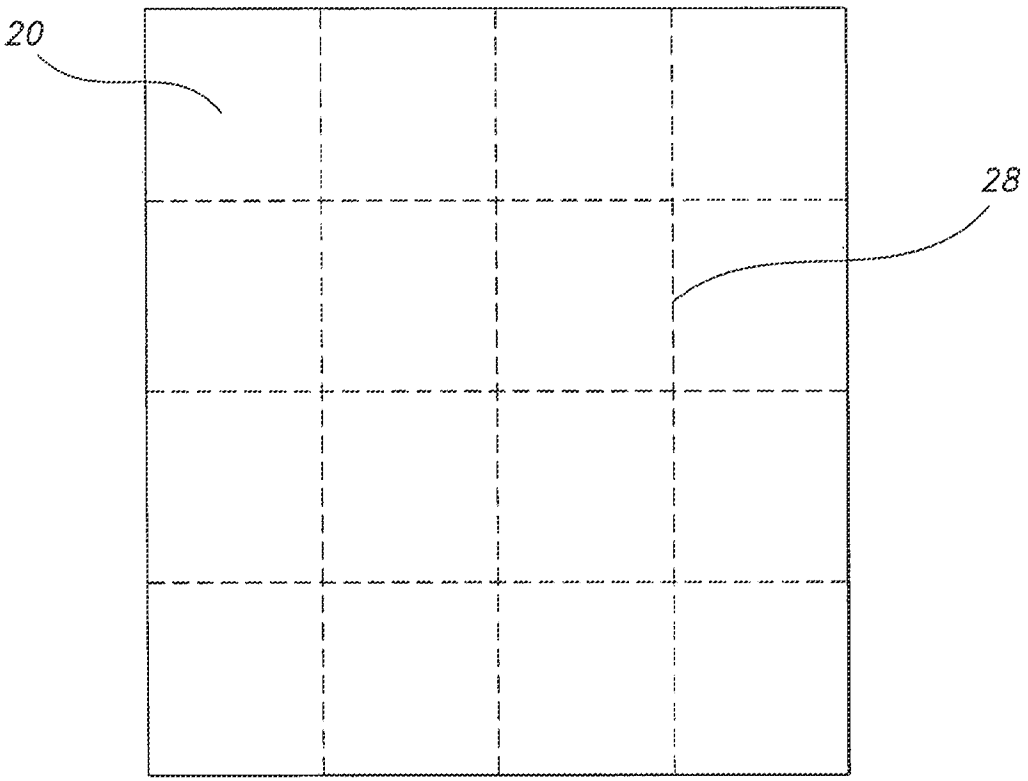
FIG. 3 is a top plan view of yet another embodiment of connectors of this invention.

Provision of the connectors 20 on a strip or sheet of release material has been found to facilitate removal of the connectors 20 from the release layer 26 and thus reduce installation time. With respect to connectors 20 provided on a strip of release material (as shown in FIG. 2), installation can also be expedited through use of a connector dispenser that holds at least one rolled or accordion folded strip of connectors 20 and that preferably also provides a mechanism for separating the connectors 20 from the release layer 26. The dispenser, which, for example, may be fashioned as a backpack or mounted on the installer's belt, preferably includes structure for supporting at least one roll of connectors 20 (and preferably more).

Figure 4:
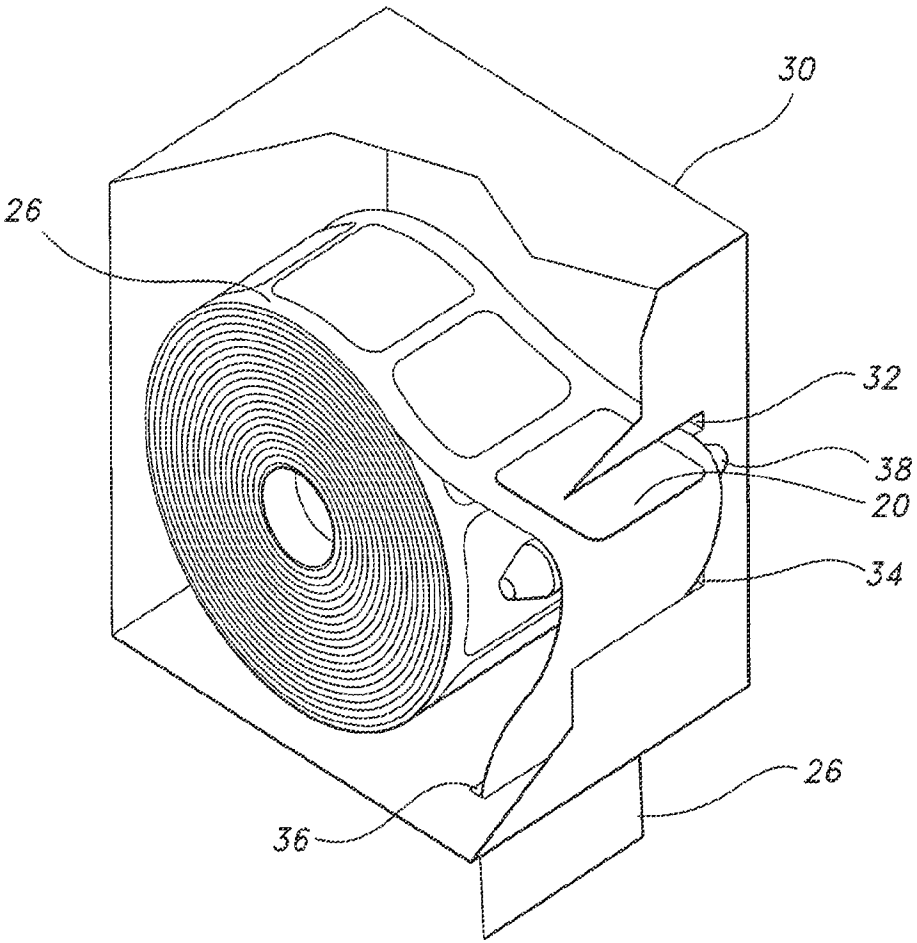
FIG. 4 is a schematic view of one embodiment of a connector dispenser of this invention.

In one embodiment of such a dispenser (see FIG. 4), a roll of release material bearing connectors 20 is housed in a box 30 made from any sufficiently-rigid material, such as, for example, plastic, metal, or cardboard. The box preferably includes three openings 32, 34, 36 through which the strip of release material is fed. The strip of release material is fed through the first opening 32, at which opening is positioned a projection 38. The release material is then fed back into the box 30 through a second opening 34 and out a third opening 36. In use, the installer pulls on the release material strip extending from the third opening 36. This, in turn, advances from the roll portions of the release layer 26 bearing connectors 20. As the release layer 26 extends over the projection 38, the connector 20, which is relatively rigid, is unable to conform to the shape of and travel over the projection 38. Instead, the connector's leading edge disengages from the release layer 26, after which the installer can easily grip the disengaged edge to remove the connector 20 fully from the release layer 26. Obviously, the more connectors the dispenser is able to support, the fewer times the installer must re-load the dispenser during installation. This can be especially beneficial during large installations.

In another embodiment of this invention, the release material 26 may be omitted entirely. Rather, the connectors 20 can be stacked on top of each other, with the adhesive layer 24 of one connector 20 contacting the film 22 of the connector 20 positioned above it in the stack. The installer then simply peels a connector 20 from the stack during installation.

in one method of installing tiles using the connectors, a first tile is placed on the floor at a position determined by conventional tile installation methods. A connector 20 is peeled from the release layer 26 (or from a stack of connectors 20) and positioned so that the adhesive layer 24 faces upward away from the underlying floor. The connector 20 is positioned so that only a portion of the adhesive layer 24 adheres to the underside of the tile, leaving the remainder of the connector 20 extending from the underside of the tile. A tile or tiles are then positioned adjacent the first tile so that a portion of the connector 20 adheres to the adjacent tile(s). In this way, the connector spans the adjacent edge(s) of the adjacent tile(s).

Any number of connectors 20 may be used to connect adjacent tiles in an installation. However, to create a stable floor covering, the connectors need not be positioned along the entirety of the adjacent tile edges nor even across all adjacent tile edges. Rather, unlike adhesive tape that has been used to secure adjacent tiles together along the entirety of adjacent tile edges, the connectors 20 of this invention need only extend along a very limited length of the adjacent edges. For example, the tiles of a floor covering installation where only 5%-10% of adjacent tile edges are stabilized with connectors 20 have been found to exhibit planar stability (measured by the cupping and/or curling of the tiles) and dimensional stability (measured by the skewing of the tiles), as well as the ability to retain their relative positions in the installation when subjected to foot traffic, rolling traffic, and stresses applied during cleaning and maintenance.

Figure 5:
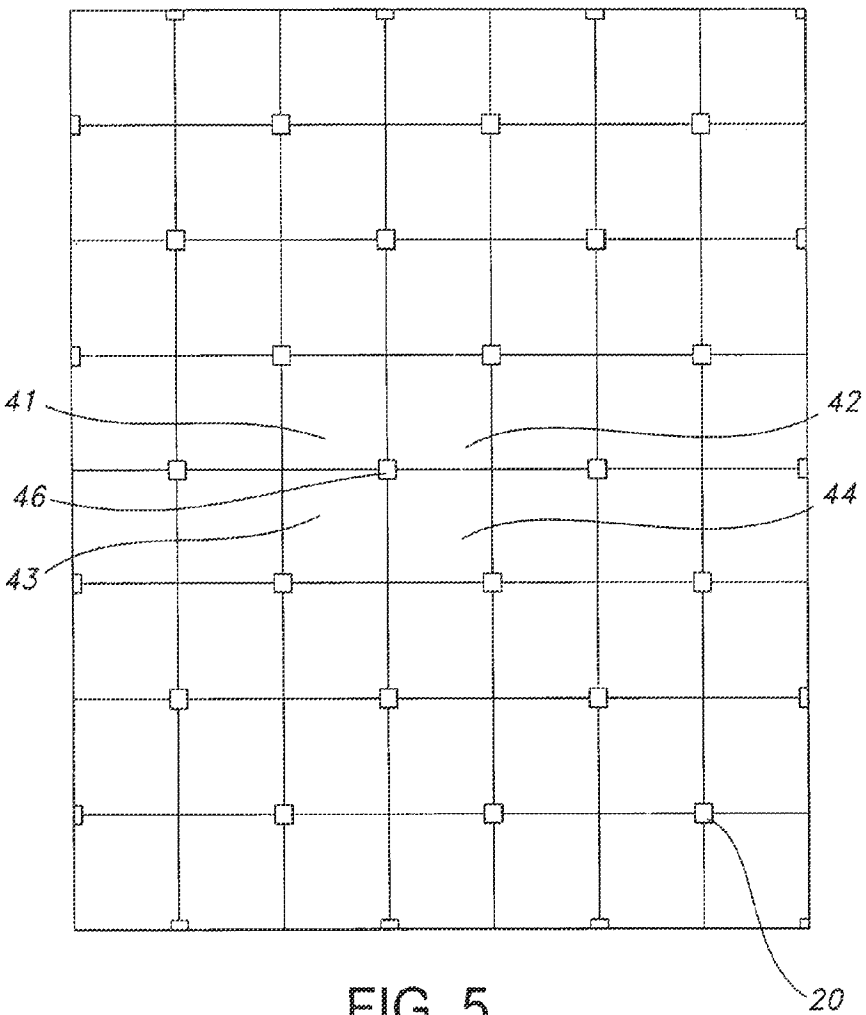
FIG. 5 is a bottom plan view of an installation of tiles pursuant to this invention.
Figure 6:
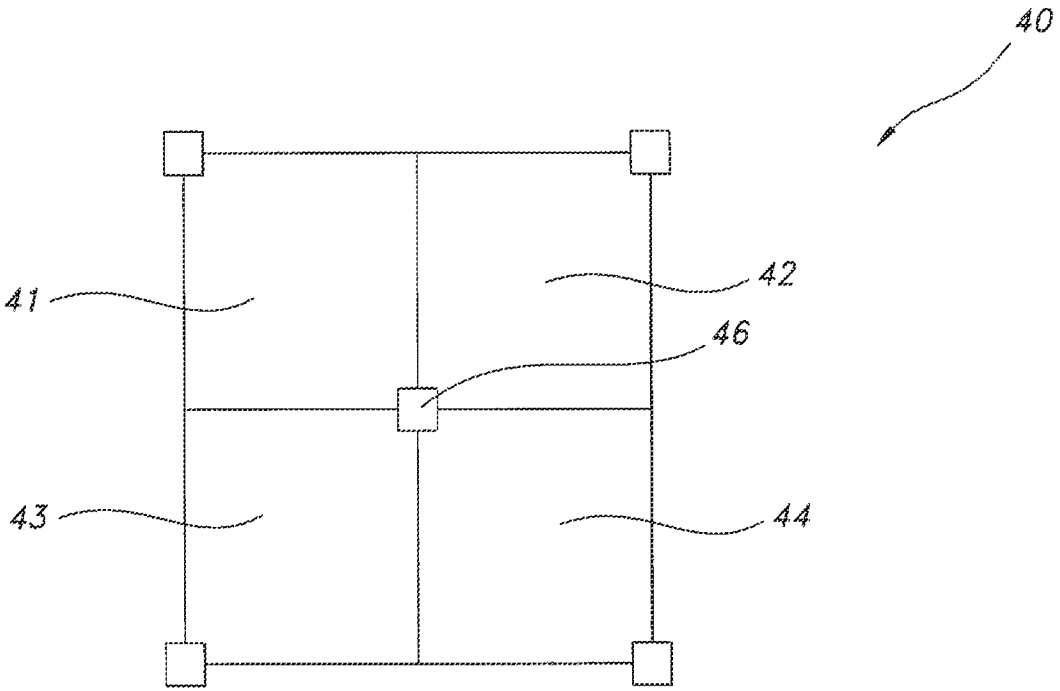
FIG. 6 is a bottom plan view of a subset of the tiles of FIG. 5.

FIG. 5 shows one embodiment of a conventional installation (i.e., in aligned columns and rows) of tiles. For ease of discussion, the positioning of the connectors is discussed relative to a basic unit 40 of four tiles 41-44, as shown and arranged in FIG. 6. Tiles 41-44 are preferably connected with a central connector 46 at the corners where they intersect. Moreover, the corner of each tile diagonal from the center connector 46 is also connected to adjacent tiles with a connector 20. In this way, only a total of two tile connectors (the center connector 46 plus a quarter of a connector at each of the four diagonal tile corners) need be used to install the basic unit 40 of four tiles 41-44. Breaking this down even further, each of the four tiles 41-44, draws its stability from, on average, only one half of the surface area of a connector.

Figure 7:
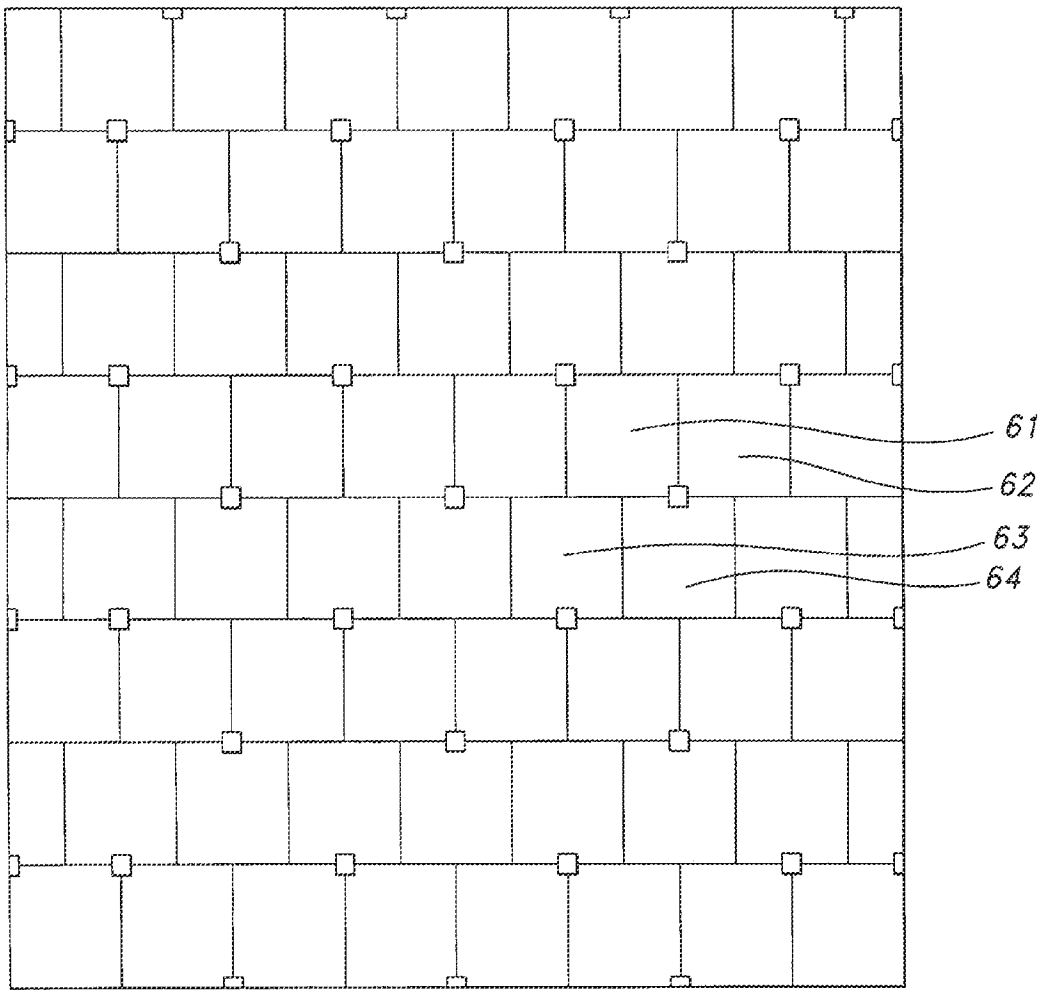
FIG. 7 is a bottom plan view of another installation of tiles pursuant to this invention.
Figure 8:
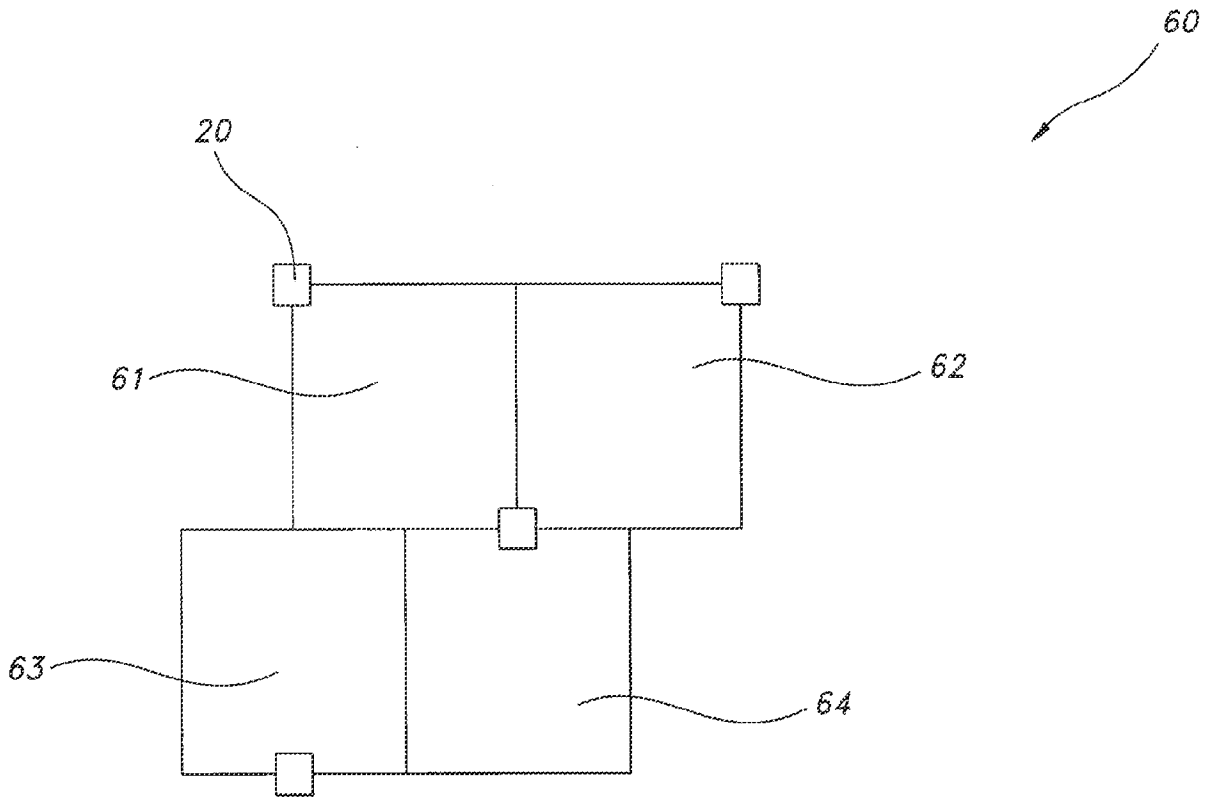
FIG. 8 is a bottom plan view of a subset of the tiles of FIG. 7.

FIG. 7 illustrates possible connector placement in a brick-laid tile installation (or ashlar installation if FIG. 7 is rotated ninety degrees). For ease of discussion, the preferable positioning of the connectors 20 is discussed relative to a basic unit 60 of four tiles 61-64, as shown and arranged in FIG. 8. As with tiles 41-44, a total of only two tile connectors (½ of a connector per each tile) need be used to install the basic unit 60 of four tiles 61-64.

FIGS. 5-8 illustrate a few of only countless connector placement possibilities for installing tiles. Connectors 20 may be positioned at arty location between adjacent tiles, and thus an given tile in the installation may contact a portion of as few as one connector and as many as feasible given the size of the tile and of the connectors 20. In addition to placement at the corners of intersecting tiles, connectors 20 may be positioned to span the adjacent edges of only two tiles. Moreover, different shaped or sized connectors 20 may be useful in a single installation. For example, in addition to the rectangular connectors shown in FIG. 5, triangular-shaped connectors may be useful at the border of an installation, such as where the tiles abut a wall.

Figure 9:
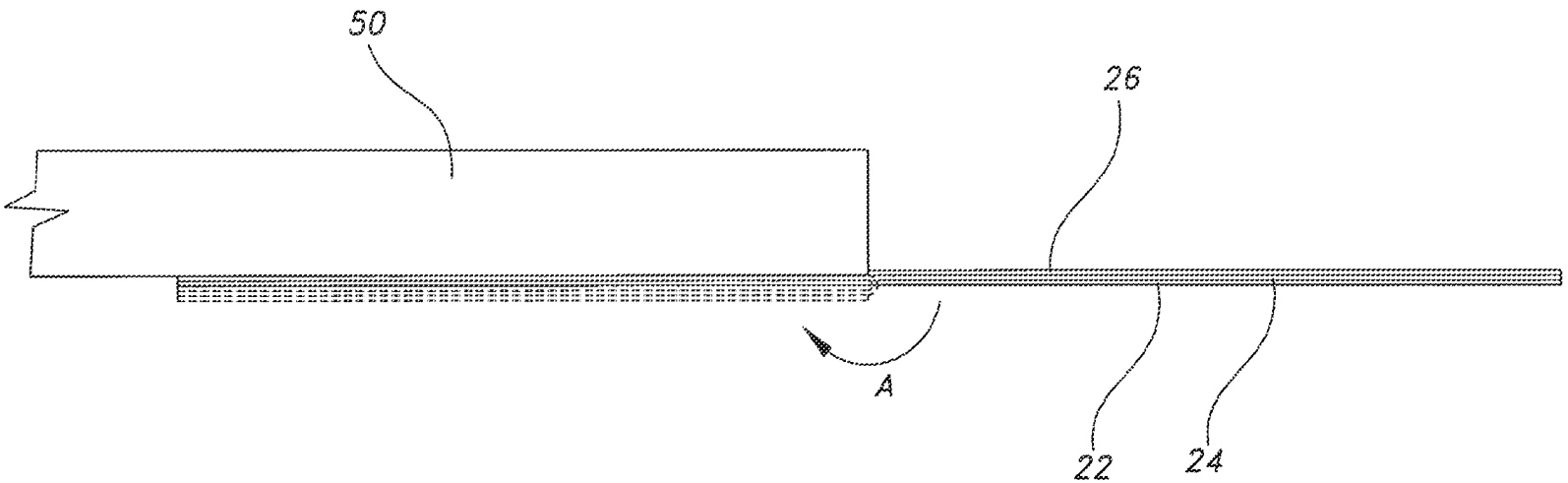
FIG. 9 is a side schematic view of an embodiment of a connector of this invention attached to a tile edge.

In addition to on-site placement of the connectors 20, it is also possible to pre-position the connectors 20 at desired locations on the tiles during manufacture. For example, the release material 26 on the connectors 20 may be perforated. During manufacture, a portion of the release material 26 can thus be removed along the perforation to expose a portion of the adhesive layer 24. That portion of the connector 20 can then be adhered to the underside of the edge of a tile 50 as discussed above (see FIG. 9). The adhesive on the remainder of the connector 20 is still protected by the remaining release material 26. To prevent the connector 20, which extends from tile 50, from interfering with packaging of tile 50 for shipment, it may be preferable to bend the connector 20 along the perforation back (in direction A) so that the underside of the connector 20 is flush with itself. During installation, the installer need only extend the connector 20 from the edge of tile 50, remove the remaining release layer 26 and install the tiles 50 as discussed above.

Because the tiles are not attached to the floor, they need not be placed directly on an underlying flooring surface. Rather, the connectors 20 of this invention work equally well with tiles positioned on an intermediate substrate positioned between the tiles and the floor. For example, a barrier material, such as a plastic sheet, may be positioned on the floor prior to tile installation. The plastic sheet can serve to protect the floor from damage, such as might be caused by liquids spilled on the tiles that escape through the tile seams, as well as serve as a barrier to moisture present in the existing floor and thereby eliminate the need for sealants and barrier coatings. Moreover, a cushion or foam pad may also be positioned on the floor before tile installation. The cushion provides comfort underfoot and also eliminates the need to use cushion back carpet tiles. Rather, hardback tiles can simply be installed on an underlying cushion pad.

The connectors of this invention improve upon current tile installation systems and methods. The connectors use both less material and cheaper materials, than traditional installation systems. Moreover, use of the connectors significantly reduces tile installation time (by as much as 60% of the time for adhesive systems) by obviating the need to prep a floor prior to installation. Rather than applying a layer of adhesive to the floor and then retracing his steps to position the tiles on the adhesive layer, with the connectors, the installer positions and secures as he goes. Moreover, given the releasable adhesive used on the connectors and the limited surface area of the tiles that contacts the connectors, the tiles can easily be repositioned if necessary. Furthermore, because the tiles do not interact with the underlying floor, they are easily removable from the floor and leave the underlying floor pristine upon such removal. Consequently, the floor does not requires refinishing before it is recovered with another floorcovering.

The embodiment described above is illustrative and non-limiting. Many variations of the structures illustrated in the drawings and the materials described above are possible and within the scope of this invention as defined in the claims.

We claim:

1. A system for installing carpet tiles on an underlying surface, the system comprising:

a plurality of carpet tiles, wherein each carpet tile comprises an underside; and a plurality of carpet tile connectors for connecting the plurality of carpet tiles, each carpet tile connector comprising:

a film having two sides; and a layer of adhesive located on a side of the film, wherein the layer of adhesive is capable of forming a bond between the film and the undersides of adjacent carpet tiles and comprises a sufficient shear strength so that, when a connector spans adjacent edges of the adjacent carpet tiles so that the layer of adhesive contacts the undersides of the adjacent carpet tiles, the connector prevents adjacent tiles from moving relative to the connector or each other thereby creating gaps between the adjacent tiles after installation, wherein the film comprises a plastic material sufficiently stiff for a connector positioned partly in contact with an underside of a carpet tile to project beyond the edge of the carpet tile in roughly the same plane as the underside of the carpet tile.

2. The system of claim 1 wherein the plastic material comprises a polyolefin, a polyamide, or a polyester.

3. The system of claim 1 wherein the film exhibits a tensile strength between 160 and 270 MPa, inclusive, in at least one direction.

4. The system of claim 1 wherein at least one of the plurality of connectors has a surface area of approximately 9 inches square.

5. The system of claim 1 wherein at least one of the plurality of connectors has a film that comprises a thickness between approximately 0.0005 and 0.015 inches, inclusive.

6. The system of claim 1 wherein at least one of the plurality of connectors has a film that comprises a thickness between approximately 0.003 and 0.01 inches, inclusive.

7. The system of claim 1 wherein the layer of adhesive comprises a releasable adhesive.

8. The system of claim 1 wherein the film comprises a dimension and wherein the film is capable of being stretched at least 120% of the dimension before breaking.

9. The system of claim 1 wherein the connector is adapted to connect the adjacent carpet tiles together without attaching the carpet tiles to the underlying surface on which the tiles are positioned.

10. The system of claim 1 wherein the plurality of connectors are provided in a roll.

11. The system of claim 10 wherein the plurality of connectors are provided on release material.

12. The system of claim 1 wherein the plurality of connectors are provided on a strip of release material folded into an accordion shape.

13. The system of claim 1 wherein the plurality of connectors are provided in a stack.

14. The system of claim 1 wherein the system further identifies that, to install the carpet tiles using the connectors, a first carpet tile is placed on the underlying surface; a connector is then positioned so that only a first portion of the connector adheres to the underside of the first carpet tile leaving a second portion of the connector extending from the underside of the first carpet tile, and an adjacent carpet tile is then positioned adjacent to the first carpet tile on the underlying surface so that the second portion of the connector adheres to the adjacent tile.

* * * * *

UNITED STATES PATENT AND TRADEMARK OFFICE

CERTIFICATE OF CORRECTION

PATENT NO. : 8,434,282 B2
APPLICATION NO. : 13/595487
DATED : May 7, 2013
INVENTOR(S) : Graham A. H. Scott et al.

It is certified that error appears in the above-identified patent and that said Letters Patent is hereby corrected as shown below:

--In the specification, in the "Background of the Invention", column 2, line 40, please delete "Modules have also be installed" and insert --Modules have also been installed--

--In the specification, in the "Summary of the Invention", column 4, line 2, please delete "installation instead of" and insert --installation. Instead of--

--In the specification, in the "Detailed Description of the Drawings", column 4, line 49, please delete "(o, hexagons," and insert --to hexagons,--

--In the specification, in the "Detailed Description of the Drawings", column 5, line 64, please delete "However, as a general e," and insert --However, as a general rule--

--In the specification, in the "Detailed Description of the Drawings", column 5, line 67, please delete "It has been found that a connect" and insert --It has been found that a connector--

--In the specification, in the "Detailed Description of the Drawings", column 6, line 12, please delete "Water-based adhesive rather than solvent based adhesives)" and insert --Water-based adhesive (rather than solvent based adhesives)--

--In the specification, in the "Detailed Description of the Drawings", column 8, line 33, please delete "in one method" and insert --In one method--

--In the specification, in the "Detailed Description of the Drawings", column 9, line 18, please delete "positioned at arty" and insert --position at any--

--In the specification, in the "Detailed Description of the Drawings", column 9, line 19, please delete "thus an given" and insert --thus any given--

Signed and Sealed this
Eighteenth Day of June, 2013

Teresa Stanek Rea

Teresa Stanek Rea
*Acting Director of the United States Patent and Trademark Office*